US008272137B2

(12) United States Patent
Logsdon

(10) Patent No.: US 8,272,137 B2
(45) Date of Patent: Sep. 25, 2012

(54) SELECTIVE FIBER OPTIC SIGHT SYSTEM

(76) Inventor: Michael Craig Logsdon, New Hope, KY (US)

( * ) Notice: Subject to any disclaimer, the term of this patent is extended or adjusted under 35 U.S.C. 154(b) by 0 days.

(21) Appl. No.: 13/100,885

(22) Filed: May 4, 2011

(65) Prior Publication Data

US 2011/0271536 A1 Nov. 10, 2011

Related U.S. Application Data

(60) Provisional application No. 61/332,046, filed on May 6, 2010.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 3,475,820 | A | * | 11/1969 | Kergen | 33/265 |
| 3,696,517 | A | * | 10/1972 | Larson | 33/265 |
| 4,400,887 | A | | 8/1983 | Mason | |
| 4,617,741 | A | * | 10/1986 | Bordeaux et al. | 124/87 |
| 5,379,746 | A | * | 1/1995 | Sappington | 124/87 |
| 5,435,068 | A | | 7/1995 | Thames | |
| 5,575,072 | A | | 11/1996 | Eldridge | |
| 6,042,245 | A | | 3/2000 | Stanley | |
| 6,154,971 | A | * | 12/2000 | Perkins | 33/265 |
| 6,397,483 | B1 | | 6/2002 | Perkins | |
| 6,494,604 | B2 | | 12/2002 | Khoshnood | |
| 6,634,111 | B2 | * | 10/2003 | LoRocco | 33/265 |
| 6,725,854 | B1 | | 4/2004 | Afshari | |
| 6,892,462 | B2 | * | 5/2005 | Rager | 33/265 |
| 2002/0083602 | A1 | * | 7/2002 | Slates | 33/265 |
| 2005/0246909 | A1 | * | 11/2005 | Rager | 33/265 |
| 2009/0165314 | A1 | * | 7/2009 | Khoshnood | 33/265 |
| 2011/0296699 | A1 | * | 12/2011 | Mainsonneuve et al. | 33/228 |

* cited by examiner

*Primary Examiner* — G. Bradley Bennett

(74) *Attorney, Agent, or Firm* — Daniel Boudwin; Alex Boyer

(57) ABSTRACT

An archery sight device for selectively illuminating fiber optic range markers calibrated to a specific distance, a selector switch and a range indicator display for accurately aiming and releasing an arrow at a designated target. The sight device comprises a housing that attaches between the upper and lower limb of an archery bow, and provides a sight window with a plurality of fiber optic pins with illuminating tips. A selective pin or set of pins is illuminated at a time, corresponding to a distance indicated by a digital display for the user to reference. A selector switch extending from the device and attached to the bow allows the user to cycle through pre-calibrated distances for a specific bow, while a range finder device may be incorporated to accurately measure the distance to a target and adjust the display and chosen illuminated pin as required. The device provides a means to accurately determine range and aim at a target, along with a sight window that reduces excess information and sighting problems associated with current fiber optic sights.

9 Claims, 2 Drawing Sheets

SELECTIVE FIBER OPTIC SIGHT SYSTEM

CROSS REFERENCE TO RELATED APPLICATION

This application claims the benefit of U.S. Provisional Application No. 61/332,046 filed on May 6, 2010, entitled "Selective Fiber Optic Sight System."

BACKGROUND OF THE INVENTION

1. Field of the Invention

The present invention relates to archery bow sights. More specifically, the present invention relates to a bow sight with selectively illuminating fiber optic pins, a digital range display and optional range finder interoperability.

2. Description of the Prior Art

Archery and bow hunting requires precision aiming devices in order to determine a target distance and to properly adjust the arrow trajectory for the given distance. Compensation of the arrow trajectory takes into account the arrow forward velocity and the force of gravity pulling it down over that distance. Inaccurate sighting and off-target releases can cause several problems, including loss of arrows or wounding a target animal rather than disabling or killing it with a properly aimed release.

Devices currently in the art and available for sale include those with a sighting window and lighted fiber optic pins for displaying a projected arrow strike location at a predetermined distance. Generally, a plurality of fiber optic pins is illuminated simultaneously with different color tips to indicate different ranges. The target is determined by a range finder or by estimation, and the inclination of the bow is adjusted to place the corresponding range pin on the target within the sighting window. The notch of the arrow is pulled towards the user, while the bow is tilted to an angle that places the corresponding marker on the target prior to arrow release. The sight pins are pre-calibrated to account for elevation drop over a distance, given the arrow velocity and range.

Several problems arise utilizing current fiber optic sighting devices and their methods of use. First, illuminating several fiber optic pins simultaneously can cause confusion for a user when selecting the correct pin for the given range. The different pins are calibrated for a given distance, distances that the user must memorize while aiming. This can lead to confusion and mistakes when choosing a pin for a given distance, especially in situations of high pressure where a target animal is in sight or moving. If the incorrect pin is placed on the target, the arrow will likely miss the target, falling short or overshooting the target.

The pins also lack an indicator that notifies the user of a corresponding distance for a chosen pin. Without a reference, the user must rely on his or her memory and determine which pin corresponds to a preset distance. This method introduces inherent user error, which is avoided in the present invention. Also common when illuminating several pins simultaneously is the halo or starburst effect that may occur when the user looks at several light sources, particularly in low light situations. The combined lights may cause visual effects that can alter the vision of a user, disrupting his or her ability to focus on the target and choose a particular pin. This effect is of particular concern when several pins are clustered close together, which is common for high power, compound bow sights. These bows are capable of propelling an arrow with a flatter trajectory, which reduces the elevation drop over a given distance and reduces the gap between sighting pins.

Finally, the method of estimating a target distance and choosing the correct pin can easily lead to errors and missed targets. Considerable error is introduced when a user is asked to visually determine a given target's distance. The pins in the sighting window correspond to different preset distances; if the incorrect distance is estimated, the arrow will undershoot or overshoot the target, especially for novice and beginner bow hunters and marksman. The ability to integrate a laser range finder device is ideal for this situation, particularly one that can be integrated into the bow sight for designating a target, displaying to the user its distance and automatically selecting a given pin for aiming purposes.

The present invention is a new fiber optic bow sight that takes into account the drawbacks of the prior art and advances the field of archery sighting. The present invention provides a remedy for the aforementioned problems associated with archery sighting systems by providing a device that illuminates a particular pin or set of pins based on pre-calibrated distances, provides a user with a digital range display for reference, and finally has built-in microprocessor to accept input from the user, and allow integration of a third party range finder device. The microprocessor logic accepts signals from a range finder and illuminates a pin for a given distance, eliminating any error or dependence on user memory or judgment.

Several devices have been patented and described in the prior art that also attempt to remedy the current drawbacks of fiber optic bow sights. These devices, however, fall short of providing an easy-to-use system that eliminates a majority of error in the sighting process. They describe sights with unobstructed views, integration of a range finder and illumination of pins within a sighting window, but fail to combine several elements that eliminate error associated with determining distance and modifying the sight to accommodate for a distance, while providing the user with a digital display and finger button input for controlling the device.

U.S. Pat. No. 5,435,068 to Thames describes one such device, in which an array of closely clustered fiber optic pins is provided with variable intensity and varying colors. This device proposes to allow a user to differentiate between the pins, as well as reduce any halo effect of several lights converging within a close proximity to each other. A finger control allows the user to change the light intensity and control the sight while the bow is in use. This patent describes an optical sight that utilizes several simultaneously lit optical pins, which does not completely eliminate all sighting problems for an archer, and still introduces a level of confusion when referencing a specific color to correspond with a target distance.

U.S. Pat. No. 6,042,245 to Stanley describes a switch attachment device for a bow sighting device. While this device expands on the versatility and usability of a bow sight, it does not describe a bow sighting system as a whole.

U.S. Pat. No. 6,725,854 to Afshari describes a fiber optic bow sighting device that does not utilize an electronic means for lighting a fiber optic pin. The device provides a self illuminating pin that has improved visualization in low ambient light conditions. While this device eliminates any dependence on electronic means to provide illumination to a fiber optic pin, it does not address all problems associated with current fiber optic pin sighting devices.

U.S. Pat. No. 5,575,072 to Eldridge describes an automatically adjusting sight device based on a range finding means, including a circuit that controls the input from the range finder and logic to adjust the sighting pins. The device describes a program and circuit logic that controls movement of the sighting pins without input from the user for properly aiming a bow at a given target. The device describes the control mechanism and a program to enable its use, rather than a sighting device as a whole.

Other devices that describe selectively illuminating sight pins include U.S. Pat. No. 6,397,483 to Perkins, U.S. Pat. No. 6,494,604 to Khoshnood, and finally U.S. Pat. No. 4,400,887 to Mason. The Perkins patent describes a sighting device that provides unobstructed view of the target through a sight, and illuminates a single pin based on a microprocessor and range finder. The Khoshnood and Mason patents similarly describe a single illuminating sight pin; however these devices differ in structure and intent from the present invention.

The current invention relates to an improved fiber optic bow sight in which user error is eliminated with regard to determining a target range, selecting an appropriate sighting pin and ensuring that pin corresponds with the correct distance. It substantially diverges in design elements from the prior art and consequently it is clear that there is a need in the art for an improvement to existing fiber optic sight devices. In this regard the instant invention substantially fulfills these needs.

SUMMARY OF THE INVENTION

In view of the foregoing disadvantages inherent in the known types of fiber optic bow sights now present in the prior art, the present invention provides a new fiber optic bow sight wherein the same can be utilized for providing convenience for the user when selectively illuminating sight pins within a sighting window, verifying a pin's corresponding range and integrating an optional range finder device for determining a given range to target.

It is therefore an object of the present invention to provide a bow sight that utilizes fiber optic pins with illuminated tips, and for illuminating a selective pin or set of pins at a time within the sighting window. This improves visualization of the target, reduces clutter and confusion within the sighting window, and eliminates reliance on user memory for choosing the correct sight pin. The pins are adjustable within the sighting window to calibrate their corresponding distance for a particular bow.

Another object of the present invention is to provide a range display for the user to reference, comprising a digital display that shows a numeric distance for a specific pin or set of pins, or alternatively a range to target based on an integrated range finder device.

Another object of the present invention is to provide interoperability with a range finder device that can provide the user with accurate distance information, improving the capability of the device by accepting signals from the range finder and automatically selecting the appropriate sighting pin to account for arrow elevation drop over the measured distance, as well as removing any range estimation from the process.

Another object of the present invention is to integrate the range finder with the illumination pins, in which the distance determined by the range finder is communicated to a microprocessor that automatically chooses the appropriate sighting pin or set of pins to selectively illuminate.

Another object of the present invention is to provide an adjustable sighting window that can be rotated left to right for cross wind adjustment.

Another object of the present invention is to provide the user with a push button controller for the device to cycle through preset sighting pins and preset distances.

Yet another object of the present invention is to provide a means to control the intensity of sighting pins within the sighting window.

It is therefore an object of the present invention to provide a new and improved fiber optic sighting device that has all of the advantages of the prior art and none of the disadvantages.

Other objects, features and advantages of the present invention will become apparent from the following detailed description taken in conjunction with the accompanying drawings.

BRIEF DESCRIPTIONS OF THE DRAWINGS

The present invention will be better understood and the objects set forth above will become more apparent after a study of the following detailed description thereof. Such description makes use of the annexed drawings wherein.

DETAILED DESCRIPTION OF THE INVENTION

Figure 1:
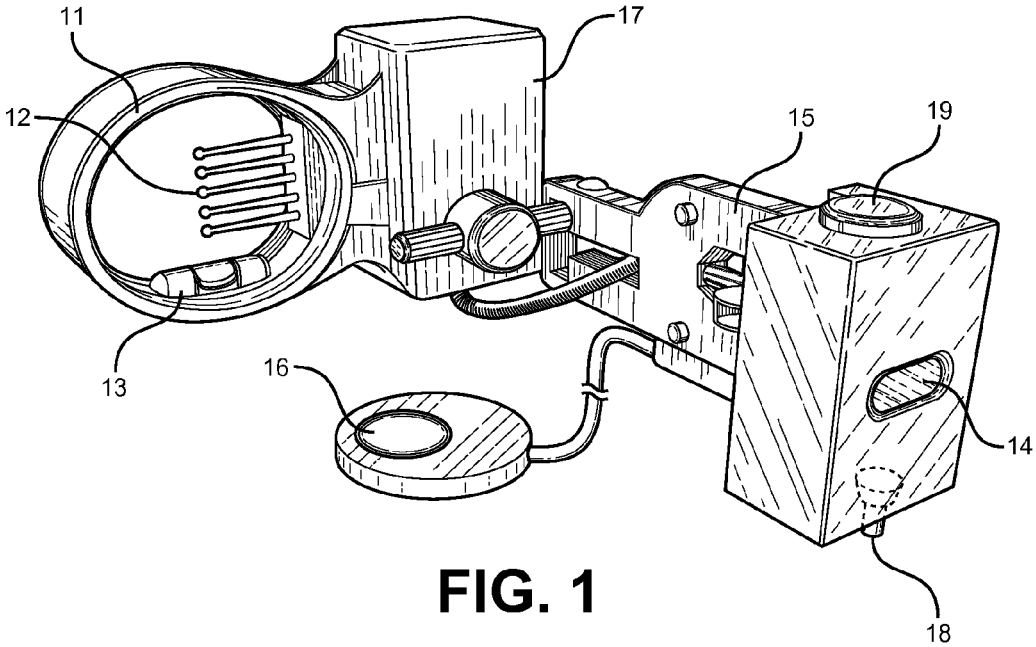
FIG. 1 shows a rear perspective view of the present invention.

Referring now to FIG. 1, there is shown a rear perspective view of the present invention, wherein a sighting device is provided for attachment to an archery bow. The device comprises a circular sighting window 11, in which a user looks directly through to visualize a down range target. A plurality of vertically stacked sighting pins 12 are provided within the sighting window 11, which extend from an inner side and terminate along a central axis within the window 11. The sighting pins 12 comprise fiber optic wires that are shielded with non-transparent material up to their tips, wherein light may escape to provide an illuminated point. Each pin 12 may be illuminated with a different color. The device provides power to a selective pin or set of pins 12 at a time, reducing any collocation of light sources within the sighting window 11, which can block the view of a target and cause distracting visual effects on the human eye. A leveling means 13 is also provided within the sighting window.

The sighting window 11 attaches to a housing 17, which is clamped to an arm structure 15. An arm structure 15 provides connection between the sighting window 11 and a display structure 14, while also providing a path to route electrical connections and a means to attach the sight to an archery bow. Illumination of the sight pins is provided by imbedded light emitting diodes (LEDs) encased in the display structure, which utilizes a specially designed manifold assembly that prevents ambient light from entering the fiber optic strands, as well as isolating each individual LED and fiber optic strand to prevent an illuminated LED from being a light source for a null selected sight pin. This allows selective pin illumination.

The sighting pins are adjustable within the sighting window along a vertical axis. This provides a user with the ability to calibrate each pin for a specific distance prior to setting the pin locations and utilizing them in the field. Specific pins correspond to a specific strike location yardage down range, which must be tested for different bows, given their differing release velocities. For a given range, a singular pin is illuminated and the distance is displayed on the display structure. For yardages between pints, for instance for ranges between 20 and 30 yard pin markers, the range indicator would display 25 yards and both 20 and 30 yard pins would be illuminated. The target would be placed between the two pins to prevent hold over or hold under misjudgment. The intensity of the pin illumination is controlled by a rotating knob 18 at the base of the display structure 14.

The display 14 provides a means to communicate the distance of a target and the distance of the illuminated pin 12 within the window 11 to the user. It comprises a digital display interface that provides a numeric output for the user to reference when aiming at a target and choosing a pin 12 for the given distance to target.

Within the body of the display 14 structure houses a microprocessor and electric circuit that provides control over the illuminating pins 12 and the display 14. It also receives input from a user-controlled micro push button device 16, as well as input from a third party ranger finder device that is attachable to the base of the present invention. The microprocessor is battery powered and allows the user to cycle through sight distances and accept input signals from a third party laser range finder. The assembly may be disassemblable, allowing cleaning and maintenance of the device by separating the sighting window 11 from the arm 15 and the display 14.

Figure 2:
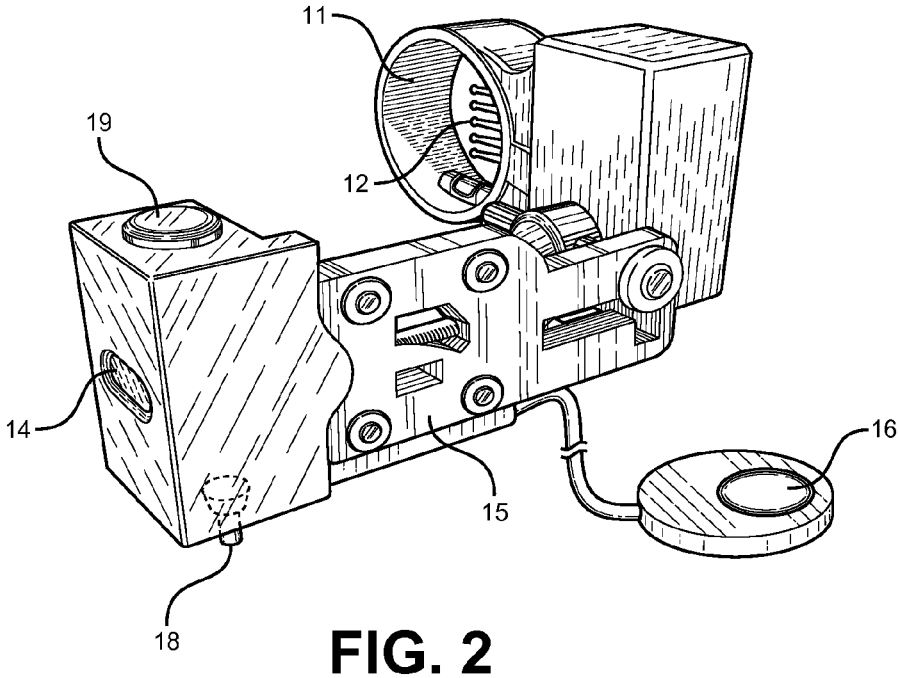
FIG. 2 shows a side perspective view of the present invention.

Referring now to FIG. 2, there is shown a side perspective view of the present invention, showing the back side of the connection arm 15 between the sighting window 11 and the user display 14. A plurality of fasteners is provided along the arm 15 for attachment to an archery bow, while a push button controller 16 is provided on the display structure 19 or alternatively below the arm 15. The button 16 is attachable to the bow, allowing the user to manipulate the sight settings while visualizing a target and preparing to release an arrow. Alternatively, the user may utilize the button 19 above the display housing for the same feature. A knob 18 below the housing is used to control the intensity of the lighted pins 12 in the viewing window 11.

Figure 3:
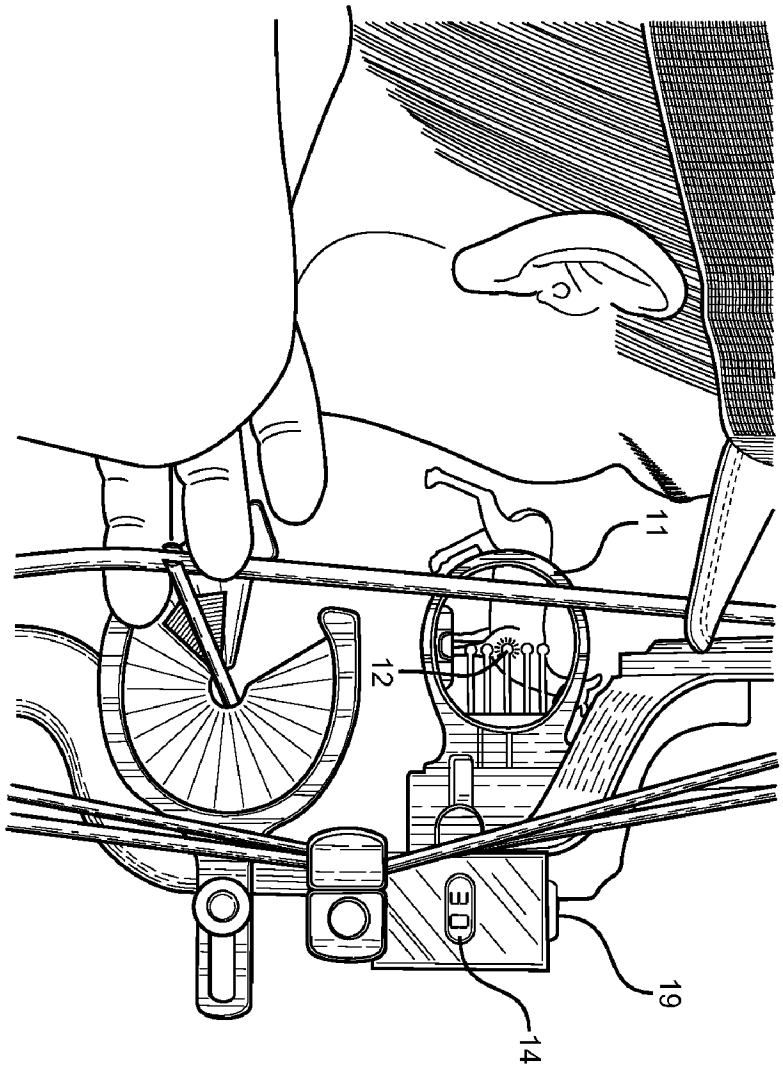
FIG. 3 shows a rear view of the present invention in its working position.

Referring now to FIG. 3, there is shown a view of the present invention in its working position, wherein a user is visualizing a target through the sighting window 11, selecting a preset distance 14 or accepting a range from a range finder device and selecting the appropriate sighting pin 12 prior to pulling the arrow into a firing position. The device is attached to the bow above the arrow rest, allowing the user to peer down the length of the arrow and into the sighting window 11 at the target. The push button controller is mounted below the arrow rest and above the handle of the bow, allowing the user to toggle through sighting options without releasing his or her hand from the bow handle.

The device operates by encasing a battery-powered microprocessor that controls input and output signals from both the digital display and the fiber optic pins simultaneously, and in sequential order. An LED light source is provided at the ends of each fiber optic pin, generated from within the display enclosure. The display is updated as the selected pin is changed, and indicates the corresponding yardage for a selective pin or set of pins illuminated by the light source. The remote button device can be utilized to provide a required input voltage or signal to the microprocessor to initiate the sequential illumination of the pins and cycle through the displayed distances. Simply depressing the remote button enables a fiber optic pin selection and corresponding yardage indication, sequentially, each time the push button is pressed and released, thus providing a single aiming point and verification that a selected pin is appropriate for the intended distance.

The present invention provides a device that houses internal electronics, a power source and a shielded light source for the pins. The device is attachable to any archery bow and may be calibrated thereon. In use, only a select pin or set of pins is illuminated at one time, which reduces visual effects such as halo or starbursts that prevent clear visualization of the pins and the down range target. Intensity of the fiber optic sighting pins may also be adjusted by the user to reduce these visual effects. The internal microprocessor accepts input from the user and updates the visual display and corresponding sight pin for a chosen distance. The orientation of the sighting window is adjustable left to right, allowing compensation for cross winds by angling the direction of the window.

In a preferred embodiment of the present invention, the components of this device may include an ABS plastic display/circuitry enclosure measuring approximately 2" H×1 ¼" W×¾" D, ABS plastic LED/Fiber Optic faceted manifold with mounting screws measuring approximately 2" H×⅜" W×½" W overall. There can also be a normally open micro switch wired to the circuitry enclosure that is used as the input signal voltage for the LED/Display circuit. 9" of 22 gauge control wire that can be split into two sections. Five strands of shielded (non-transparent) fiber optic cable is provided, measuring approximately 5 mm in diameter and 6 inches in length of assorted colors such as red, green and yellow. Finally there can be three sections of black shrink wrap tubing for repelling ambient light and protecting the wire and fiber optic cables. The device operates by an encased battery-powered micro processor that controls output and input signals to both the digital display and the LEDs simultaneously, and in sequential order. The light source is generated to the ends of the fiber optic cables enclosed and separated by the manifold assembly and the display is changed to indicate the appropriate yardage for the pin illuminated by the powered LED.

In an exemplary embodiment of the present invention, a range finder device is integrated into the device to automatically measure a distance to a target, provide input to the microprocessor and update the display/pin illumination. The range finder may be mounted on the bow directly or to the sight device, depending on user preference.

In total, the device provides a bow sighting device that eliminates the visualization drawbacks of the prior art, selectively illuminating a selective pin or set of pins within the sighting window and displaying the range to the user. Control over the intensity of the illuminated pin is also provided. Internal logic within the microprocessor and the circuit provides means to control the illumination and display, as well as optionally incorporate a third party range finding device for foolproof distance measuring. The device drastically improves accuracy, particularly over large distances and in situations where time is critical, such as deer hunting applications.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bow sight, comprising:

a sighting window with a plurality of selectively illuminated fiber optic sighting pins vertically stacked therein;

a display structure with an internal cavity and a visual range indicator corresponding to said selectively illuminated fiber optic pin or set of pins, said internal cavity for housing an electric circuit, microprocessor and battery power;

an arm structure for connecting said sighting window to said display structure, and attaching said bow sight to a bow;

a push button device for cycling through said illuminated pins and said corresponding range indicator a turn knob provided below said display structure for varying said sighting pin intensity within said sighting window.

2. A device as in claim 1, wherein a range finder device provides distance measurement input to said microprocessor for automatically activating a select illuminating pin or set of pins corresponding to said measurement and for displaying said measurement on said display.

3. A device as in claim 1, wherein said sighting window, said arm structure and said display structure are disassemblable from one another.

4. A device as in claim 1, wherein each of said illuminated fiber optic pins is illuminated with a different color.

5. A device as in claim 1, wherein another push button device is provided for attachment to said bow, providing for cycling through said illuminated pins and said corresponding range indicator.

6. A bow sight, comprising:

a sighting window with a plurality of selectively illuminated fiber optic sighting pins vertically stacked therein;

a display structure with an internal cavity and a visual range indicator corresponding to said selectively illuminated fiber optic pin or set of pins, said internal cavity for housing an electric circuit, microprocessor and battery power;

an arm structure for connecting said sighting window to said display structure, and attaching said bow sight to a bow;

a push button device for cycling through said illuminated pins and said corresponding range indicator a turn knob provided below said display structure for varying said sighting pin intensity within said sighting window a range finder device for providing distance measurements to said microprocessor for automatically activating a select illuminating pin or set of pins corresponding to said measurement and for displaying said measurement on said display.

7. A device as in claim 6, wherein said sighting window, said arm structure and said display structure are disassemblable from one another.

8. A device as in claim 6, wherein each of said illuminated fiber optic pins is illuminated with a different color.

9. A device as in claim 6, wherein another push button device is provided for attachment to said bow, providing for cycling through said illuminated pins and said corresponding range indicator.

* * * * *